United States Patent [19]

McNab et al.

[11] Patent Number: 4,467,696

[45] Date of Patent: Aug. 28, 1984

[54] ELECTROMAGNETIC PROJECTILE LAUNCHER WITH COMBINATION PLASMA/CONDUCTOR ARMATURE

[75] Inventors: Ian R. McNab, Murrysville; George A. Kemeny, Wilkins Township, Allegheny County, both of Pa.

[73] Assignee: Westinghouse Electric Corp., Pittsburgh, Pa.

[21] Appl. No.: 381,602

[22] Filed: May 24, 1982

[51] Int. Cl.[3] ..... F41F 1/00

[52] U.S. Cl. ..... 89/8; 124/3; 310/12; 318/135

[58] Field of Search ..... 89/8; 124/3; 310/12; 318/38, 135; 102/520, 521, 522, 523

[56] References Cited

U.S. PATENT DOCUMENTS 1,370,200 3/1921 Fauchon-Villeplee ..... 124/3

4,343,223 8/1982 Hawke ..... 89/8

OTHER PUBLICATIONS

Deis et al., "Experimental Launcher Facility–ELF–I: Design and Operation," IEEE Transactions on Magnetics, vol. Mag. 18, No. 1, Jun. 1982.

Sands et al., Powder Metallurgy, 1966, pp. 206–208.

R. A. Marshall, "Railgun Overview, " Proceedings of the Impact Fusion Workshop, LA-8000-C Conference VC-21, Aug. 1979, pp. 128–131, 141, 142.

*Primary Examiner*—Stephen C. Bentley

*Attorney, Agent, or Firm*—R. P. Lenart

[57] ABSTRACT

An electromagnetic projectile launcher includes a combination plasma/conductor armature structure which serves to conduct current between a pair of generally parallel conductor rails and to propel a projectile along the rails. A plasma at each end of the conductive element of the armature serves to conduct current between the conductive element and the adjacent conductor rail. A method of launching a projectile in an electromagnetic projectile launcher is provided in which a sliding conductive element conducts current between a pair of generally parallel launching rails until a selected velocity is achieved. At that time, plasmas are generated at each end of the conductive element. These plasmas serve to transfer current between the conductive element and the launcher rails for the remainder of the launch.

26 Claims, 8 Drawing Figures

ELECTROMAGNETIC PROJECTILE LAUNCHER WITH COMBINATION PLASMA/CONDUCTOR ARMATURE

BACKGROUND AND SUMMARY OF THE INVENTION

This invention relates to electromagnetic projectile launchers and more particularly to such launchers wherein the means for conducting current between a pair of generally parallel conductive rails includes a conductive element and a plasma.

Electromagnetic projectile launchers are known which comprise of pair of generally parallel conductor rails, a sliding conductive armature between the rails, a source of high current, and a switch for commutating this current into the rails and through the armature. The passage of electrical current through the rails and the armature produces an electromagnetic force on the armature which propels it along the conductive rails. Sliding metallic armatures have generally been used in launchers which accelerate projectiles to velocities below 1000 meters per second. Launchers which utilize metallic armatures have experienced considerable rail damage caused by the sliding armature, particularly where high armature velocities are involved. For smaller projectiles and higher velocities, a plasma or arc armature has been utilized.

For a plasma armature launcher, one of the dominating effects during a launch relates to the electrical resistance of the conducting plasma that conducts current between the two rails of a simple parallel rail launcher. The electrical resistance has three components:

$$R_{TOTAL}=R_{bulk}+R_{anode}+R_{cathode} \quad (1)$$

where $R_{anode}$ and $R_{cathode}$ are the resistance associated with the plasma-to-rail interfaces and $R_{bulk}$ is the bulk resistance of the plasma. It is usual to express Equation 1 in terms of a voltage as:

$$V_{TOTAL}=IR_{bulk}+V_A+V_C \quad (2)$$

where $V_A$ and $V_C$ are the anode and cathode voltage drops, respectively.

For a small bore electromagnetic launcher, calculations show that it is typical for the three contributions on the right side of Equation 2 to be of equal magnitude, typically 30 to 100 volts. However, as the bore of the launcher is scaled up to accept larger payloads, $IR_{bulk}$ increases approximately linearly with bore size, while $V_A$ and $V_C$ remain about constant. The relatively high plasma resistance can then lead to an undesirably high voltage and unnecessarily high energy loss. The present invention overcomes these drawbacks by replacing the bulk plasma with a better electrical conductor, which may be of solid or segmented construction. An arc or plasma at each end of this conductor serves to transfer current from the conductor to the adjacent conductive rails.

Thus, the metal conductor, which fills the bulk of the bore, serves to efficiently transfer current aross the bore and to transmit the generated force to the payload. The two plasmas primarily provide the electrical continuity between the metal conductor and the positive and negative rails and act as current transfer or voltage pickup elements.

An electromagnetic projectile launcher constructed in accordance with the present invention comprises a pair of generally parallel conductor rails, a source of high current, means for transferring current from the source of high current to the conductor rails, and an armature structure for conducting current between the conductor rails and for propelling a projectile along the rails. The armature structure includes a conductive element having a length less than the distance between the rails. A plasma at each end of the conductive element serves for conducting current between the conductive element and the rails. Copending commonly assigned application Ser. No. 381,603, filed on the same day as this application, discloses an electromagnetic projectile launcher employing a multiple current path combination armature and is hereby incorporated by reference.

The use of a plasma propelled armature has resulted in damage to the breech section of launcher rails during formation of the plasma. However, once the plasma is moving rapidly, very little, if any, damage occurs to the rails. An electromagnetic launcher may be constructed in accordance with this invention wherein metal-to-metal contact between the armature conductor and rails is maintained at low speeds, but an automatic transition to the previously described plasma/conductor armature would occur at high armature speeds.

The method of accelerating projectiles in such an electromagnetic projectile launcher comprises the steps of: supplying current to a pair of generally parallel conductive rails; conducting current between these rails by means of a conductor which is in physical contact with the rails and slidably disposed between the rails; and creating a plasma between each end of the conductor and the adjacent rail after the conductor has reached a predetermined velocity or position in the launcher barrel.

DESCRIPTION OF THE PREFERRED EMBODIMENTS

Figure 1:
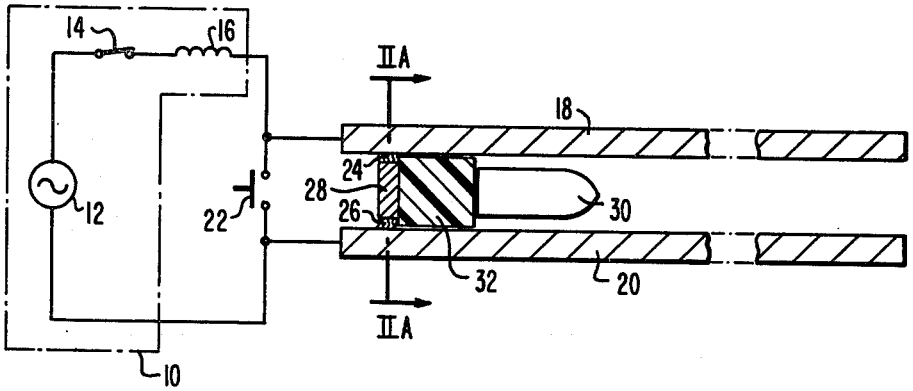
FIG. 1 is a schematic drawing of an electromagnetic launcher in accordance with one embodiment of the present invention.

Referring now to the drawings in detail, FIG. 1 is a schematic drawing of a launcher in accordance with one embodiment of the present invention. High current power supply 10 includes the series connection of generator 12, switch 14, and inductor 16. This power supply is connected to a pair of generally parallel conductor rails 18 and 20. High current switch 22 serves as a means for transferring current from power supply 10 to conductors 18 and 20. Current is conducted between rails 18 and 20 by an armature conductor comprising plasmas 24 and 26 and conductive element 28. The flow of current through conductors 18 and 20 and the armature conductor produces a force on the armature structure which propels projectile 30 along the conductors. Insulating sabot 32, which forms a component of the armature structure, is slidably disposed between conductors 18 and 20 and attached to conductive element 28. Sabot 32 serves to fix the position of conductive element 28 within the bore formed by conductors 18 and 20, thereby preventing physical contact between conductive element 28 and conductors 18 and 20. Sabot 32 also acts to seal the bore, thereby preventing forward plasma leakage. Plasmas 24 and 26 may be initiated by means of a shooting wire or fuse which bridges the gap between the ends of conductive element 28 and the adjacent conductor.

The length of conductive element 28 will generally be chosen to minimize the voltage drop of plasmas 24 and 26 while ensuring the prevention of physical contact between conductive element 28 and conductors 18 and 20 during a launch. In addition, the length of conductive element 28 should be sufficient such that accelerating forces transmitted to the projectile during a launch exerted by current flowing through the conductive element are greater than accelerating forces transmitted to the projectile by current flowing in the plasmas. Because high plasma pressures are generated by plasmas 24 and 26, the insulating sabot 32 must seal the bore to prevent deleterious forward leakage of the plasmas which can result in an arc breakdown ahead of the projectile or at the projectile.

Figure 2A:
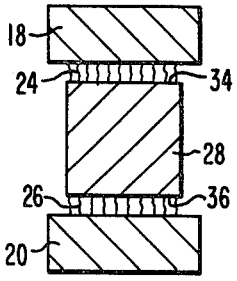
FIGS. 2A and 2B are alternative cross sections of the launcher of FIG. 1 taken along line IIA—IIA.
Figure 2B:
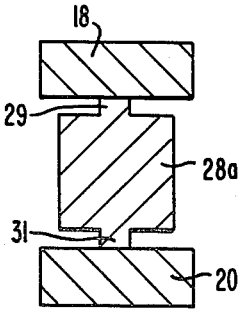

FIGS. 2A and 2B are alternative cross sections of the launcher of FIG. 1 taken along line II—II. FIG. 2A illustrates an armature conductor wherein the plasmas are initiated at the beginning of a launch. In this embodiment the ends of conductive element 28 which are adjacent conductors 18 and 20 serve as arcing faces 34 and 36 of conductive element 28. In order to decrease arc damage to the armature conductor, an arc-resistant material such as copper-tungsten can be applied to arcing faces 34 and 36, or the entire conductive element 28 can be constructed of an arc-resistant material.

FIG. 2B illustrates an armature conductor wherein conductive element **28*a* includes projections 29 and 31 having a cross-sectional area less than the cross sectional area of the central portion of conductive element 28*a*. During a launch, projections 29 and 31 are initially in physical contact with adjacent conductor rails 18 and 20. However, these projections are sized to fuse or vaporize at a preselected time following the initiation of current flow. Vaporization will occur after the projectile 30 and armature have achieved a velocity at which arc damage caused by plasmas which form between conductive element 28*a*** and the adjacent conductor rails, is minimized.

Figure 3A:
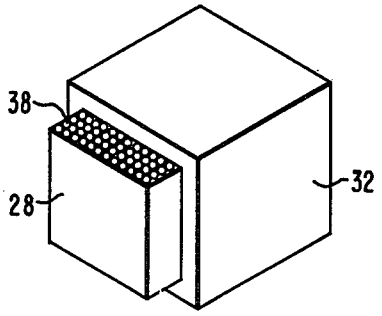
FIGS. 3A and 3B are perspective drawings of alternative armature assemblies for use in the launcher of FIG. 1.
Figure 3B:
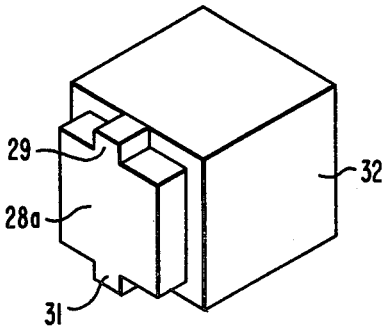

FIGS. 3A and 3B are perspective drawings of alternative armature assemblies corresponding to FIGS. 2A and 2B respectively. In the embodiment of FIG. 3A, conductive element 28 is shown as being comprised of a plurality of conductive members 38. Since transient high currents flow through conductive element 28 during a launch, conductive members 38 may be transposed in order to minimize electrical skin effects within conductive element 28.

The armature assembly of FIG. 3B includes conductive element **28*a* having projections 29 and 31 of reduced cross-sectional area. Conductive element 28*a* may be constructed of a collection of transposed conductive members in a manner similar to that shown for conductive element 28** in FIG. 3A.

Figure 4:
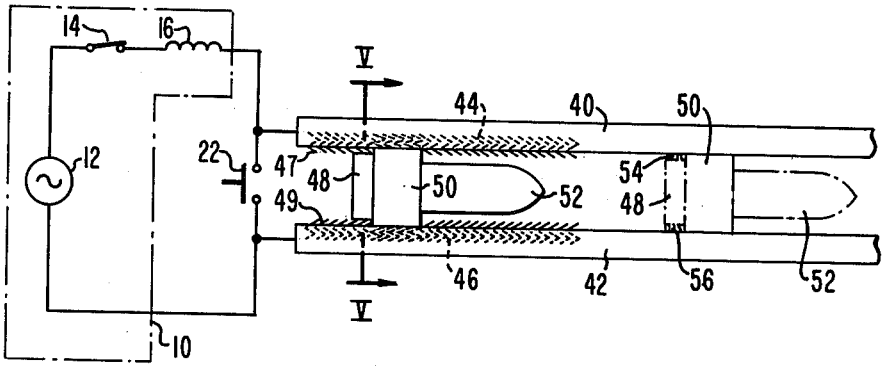
FIG. 4 is a schematic drawing of an alternative electromagnetic launcher in accordance with an embodiment of the present invention.

FIG. 4 is a schematic drawing of an electromagnetic launcher in accordance with an alternative embodiment of the present invention. High current power supply 10 is connected to a pair of generally parallel conductor rails 40 and 42. A plurality of generally chevron shaped flexible conductive inserts 44 and 46 are located in the breech area. Conductive inserts 44 are in electrical contact with conductor rail 40 and partially embedded within a portion of one side of a breech section of conductive rail 40. Conductive inserts 46 are in electrical contact with conductor rail 42 and partially embedded within a portion of one side of a breech section of conductor rail 42. Tips 47 and 49 of conductive inserts 44 and 46 extend into the bore between conductor rails 40 and 42 a sufficient distance to make physical contact with conductive element 48. Conductive element 48 is slidably disposed between conductive inserts 44 and 46 and serves as the armature conductor for the launcher in the breech area. Sabot 50 is sized to be slidably disposed between conductor rails 40 and 42. When sabot 50 is in the breech area, it applies pressure to conductive inserts 44 and 46 and compresses these inserts until tips 47 and 49 of the inserts are in line with the inner surface of conductor rails 40 and 42 in the remainder of the launcher. Current flowing through conductive element 48 as well as conductors 40 and 42 and conductive inserts 44 and 46, creates a force which propels conductive element 48, sabot 50 and projectile 52 along the bore between conductive inserts 44 and 46. When conductive element 48 passes the end of conductive inserts 44 and 46, plasmas 54 and 56 are automatically initiated to continue current conduction between conductor rails 40 and 42. Conductor inserts 44 and 46 may be made of arc resistant material or may include arc resistant material at their point of contact with said conductive element 48. Plasmas 54 and 56 may be formed simultaneously or at different locations in the barrel. However, in each case, the velocity of the armature structure and projectile assembly will be sufficient to minimize arc damage of conductor rails 40 and 42 at the point of plasma initiation. In addition, at this point sabot 50 fills and seals the bore, thereby preventing plasma leakage around the sabot.

Figure 5:
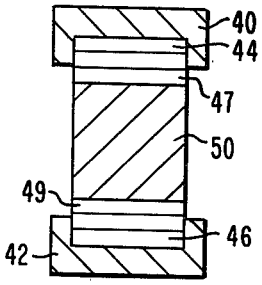
FIG. 5 is a cross section of the launcher of FIG. 4 taken along line V—V.
Figure 6:
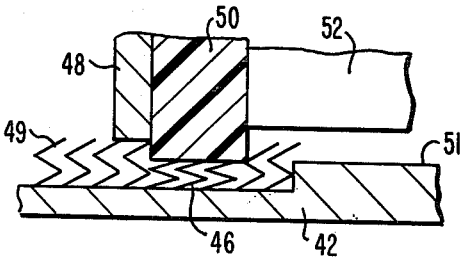
FIG. 6 is a cross section of an enlarged breech segment of one of the conductor rails of the launcher of FIG. 4.

FIG. 5 shows a cross section of the launcher of FIG. 4 taken along line V—V. At this point in the bore, conductive element 48 is in sliding contact with conductive inserts 44 and 46. FIG. 6 is a cross section of an enlarged breech segment of the launcher of FIG. 4. Conductive inserts 46 are shown to be compressed by sabot 50 such that tips 49 of conductive inserts 46 are in line with inner surface 51 of conductor rail 42.

A projectile launch performed by the launcher of FIG. 1, utilizing the armature assemblies illustrated in FIG. 2B and FIG. 3B, and a launch performed by the launcher of FIG. 4 are both in accordance with the same general method of accelerating a projectile. This method includes the steps of: supplying electric current to a pair of generally parallel conductor rails; conducting current between said rails by means of a conductor which is slidably disposed between the rails and in physical contact with them; and creating a plasma between each rail and the conductor after the conductor has reached a preselected velocity.

Although preferred embodiments of electromagnetic launchers constructed in accordance with the present invention have been shown in the drawings, it should be apparent to those skilled in the art that various modifications may be incorporated into the disclosed launcher designs without departing from the scope of this invention. For example, conductive elements 28 and 48 may be disposed within sabots 32 and 50, respectively; conductive inserts 44 and 46 may be formed as an integral part of conductor rails 40 and 42, respectively; and the shape of the individual flexible elements comprising the conductive inserts may be substantially different from the configuration shown in FIG. 6.

We claim:

1. An electromagnetic projectile launcher comprising:

a first conductor;

a second conductor disposed generally parallel to said first conductor;

a source of high current;

means for switching current from said source of high current to said first and second conductors;

a conductive element disposed between said conductors for conducting current therebetween and for propelling a projectile along said conductors;

said conductive element having a length less the distance between said conductors, such that metallic contact between said conductive element and said conductors is prohibited at all times;

a first plasma for conducting current between said first conductor and said conductive element; and a second plasma for conducting current between said second conductor and said conductive element.

2. An electromagnetic projectile launcher as recited in claim 1, further comprising:

a sabot slidably disposed between said first and second conductors;

said conductive element being associated with said sabot, whereby force is applied to said sabot when current flows through said conductive element.

3. An electromagnetic projectile launcher as recited in claim 1, wherein said conductive element includes arc resistant conductive material.

4. An electromagnetic projectile launcher as recited in claim 3, wherein said arc resistant material is copper-tungsten.

5. An electromagnetic projectile launcher as recited in claim 1, wherein said conductive element comprises:

a plurality of transposed conductive members.

6. An electromagnetic projectile launcher as recited in claim 1, wherein said conductive element is of sufficient length so that accelerating forces transmitted to said projectile during a launch exerted by current flowing through said conductive element are greater than accelerating forces transmitted to said projectile by current flowing in said plasmas.

7. An armature assembly for the conduction of current between two generally parallel conductors of an electromagnetic launcher and for the propulsion of a projectile along said conductors, said armature assembly comprising:

a conductive element having a length less than the distance between said conductors, such that metallic contact between said conductive element and said conductors is prohibited at all times;

a first plasma conducting current between a first one of said conductors and said conductive element; and a second plasma conducting current between a second one of said conductors and said conductive element.

8. An armature assembly as recited in claim 7, further comprising:

a sabot slidably disposed between said conductors;

said conductive element being associated with said sabot, whereby force is applied to said sabot when current flows through said conductive element.

9. An armature assembly as recited in claim 7, wherein said conductive element includes arc resistant conductive material.

10. An armature assembly as recited in claim 9, wherein said arc resistant material is copper-tungsten.

11. An armature assembly as recited in claim 7, wherein said conductive element comprises:

a plurality of transposed conductive members.

12. An armature assembly as recited in claim 7, wherein said conductive element is of sufficient length so that accelerating forces transmitted to said projectile during a launch exerted by current flowing through said conductive element are greater than accelerating forces transmitted to said projectile by current flowing in said plasmas.

13. An electromagnetic projectile launcher comprising:

a first conductor;

a second conductor disposed generally parallel to said first conductor;

a source of high current;

means for switching current from said source of high current to said first and second conductors;

a first plurality of conductive inserts disposed adjacent a portion of one side of said first conductor;

a second plurality of conductive inserts disposed adjacent a portion of one side of said second conductor;

a conductive element slidably disposed between and making physical contact with conductive inserts of said first and second pluralities of conductive inserts, said conductive element having a length less than the distance between said first and second conductors;

a first plasma for conducting current between said first conductor and said conductive element; and a second plasma for conducting current between said second conductor and said conductive element.

14. An electromagnetic projectile launcher as recited in claim 13, further comprising:

a sabot slidably disposed between said first and second conductors;

said conductive element being associated with said sabot, whereby force is applied to said sabot when current flows through said conductive element.

15. An electromagnetic projectile launcher as recited in claim 13, wherein said conductive element comprises:

a plurality of transposed conductive members.

16. An electromagnetic projectile launcher as recited in claim 13, wherein said conductive element includes arc resistant conductive material.

17. An electromagnetic projectile launcher comprising:

a first conductor;

a second conductor disposed generally parallel to said first conductor;

a source of high current;

means for switching current from said source of high current to said first and second conductors;

a conductive element disposed between said conductors for conducting current therebetween and for propelling a projectile along said conductors;

a projection on each end of said conductive element;

each projection having a cross-sectional area less than the cross-sectional area of said conductive element such that current flowing through said projection will cause said projections to act like a fuse after said conductive element reaches a preselected velocity.

18. An electromagnetic projectile launcher as recited in claim 17, further comprising:

a first plasma for conducting current between said first conductor and said conductive element; and a second plasma for conducting current between said second conductor and said conductive element.

19. An electromagnetic projectile launcher as recited in claim 18, wherein said conductive element is of sufficient length so that accelerating forces transmitted to said projectile during a launch exerted by current flowing through said conductive element are greater than accelerating forces transmitted to said projectile by current flowing in said plasmas.

20. An electromagnetic projectile launcher as recited in claim 17, wherein said conductive element comprises:

a plurality of transposed conductive members.

21. An electromagnetic projectile launcher as recited in claim 17, further comprising:

a sabot slidably disposed between said first and second conductors;

said conductive element being associated with said sabot, whereby force is applied to said sabot when current flows through said conductive element.

22. A method of accelerating projectiles in an electromagnetic projectile launcher comprising the steps of:

supplying electric current to a pair of generally parallel conductive rails;

conducting current between said rails by means of a conductor slidably disposed between said rails, said conductor being in physical contact with said rails and being propelled along said rails when current flows through said conductor;

creating a first plasma between one of said rails and one end of said conductor, without a reduction in the length of said conductor, after said conductor has reached a first preselected position; and creating a second plasma between a second one of said rails and a second end of said conductor, without a reduction in the length of said conductor, after said conductor has reached a second preselected position.

23. The method of accelerating projectiles as recited in claim 22, wherein said first and second positions are at the same location.

24. The method of accelerating projectiles as recited in claim 22, further comprising the step of:

sealing a bore between said generally parallel conductive rails prior to the creation of said first and second plasmas.

25. An electromagnetic projectile launcher as recited in claims 2, 8, 14 or 21 wherein said sabot is comprised of electrically nonconductive material.

26. An electromagnetic projectile launcher as recited in claims 2, 14 or 21 wherein said sabot seals a bore formed between said first and second conductors to prevent forward leakage of plasma past the sabot.

* * * * *